US010081195B2

(12) United States Patent
Imura

(10) Patent No.: US 10,081,195 B2
(45) Date of Patent: Sep. 25, 2018

(54) LIQUID RESIDUAL AMOUNT DETECTION DEVICE, RECORDING DEVICE, AND LIQUID RESIDUAL AMOUNT DETECTION METHOD

(71) Applicant: SEIKO EPSON CORPORATION, Tokyo (JP)

(72) Inventor: Kazuya Imura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/462,491

(22) Filed: Mar. 17, 2017

(65) Prior Publication Data

US 2017/0274666 A1 Sep. 28, 2017

(30) Foreign Application Priority Data

Mar. 25, 2016 (JP) ..... 2016-061374

(51) Int. Cl.
*B41J 2/195* (2006.01)
*B41J 2/175* (2006.01)

(52) U.S. Cl.
CPC .. *B41J 2/17566* (2013.01); *B41J 2002/17573* (2013.01)

(58) Field of Classification Search
None
See application file for complete search history.

(56) References Cited

U.S. PATENT DOCUMENTS

2009/0109252 A1* 4/2009 Ogle ..... B41J 2/17513 347/7
2009/0315960 A1* 12/2009 Ikeda ..... B41J 2/17566 347/86
2011/0234716 A1* 9/2011 Kubo ..... B41J 2/17513 347/86

FOREIGN PATENT DOCUMENTS

JP 2010-000701 1/2010
JP 2015-196339 11/2015
JP 2015196339 A * 11/2015
JP 2016-010879 1/2016

* cited by examiner

*Primary Examiner* — Erica Lin
(74) *Attorney, Agent, or Firm* — Workman Nydegger

(57) ABSTRACT

A liquid residual amount detection device (printing apparatus) of the invention includes an irradiation unit that performs irradiation of a detection light, and a reaction detection unit that detects a reaction by the detection light irradiated by the irradiation unit. An amount of liquid is detected based on an amount of the detection light that reaches the reaction detection unit.

14 Claims, 9 Drawing Sheets

LIQUID RESIDUAL AMOUNT DETECTION DEVICE, RECORDING DEVICE, AND LIQUID RESIDUAL AMOUNT DETECTION METHOD

BACKGROUND

1. Technical Field

The present invention relates to a liquid residual amount detection device, a recording device, and a liquid residual amount detection method.

2. Related Art

An ink cartridge which is a detachable liquid storage container, is attached to a printing apparatus with ink jet type which is an example of a liquid residual amount detection device. Some ink cartridges are provided with an optical prism for detecting that the amount of ink in the ink cartridge is less than a predetermined amount. In the liquid residual amount detection device capable of mounting such an ink cartridge, a light source for emitting light of a first wavelength and a light receiving portion for receiving light of a second wavelength are provided at positions facing the optical prism on the bottom surface of the ink cartridge. The light source for emitting light of the first wavelength emits light of the first wavelength toward the optical prism of the ink cartridges, and irradiates a light emitting substance that emits light of the second wavelength with a reflected light of the optical prism. Since the light emitting substance irradiated with the light of the first wavelength emits the light of the second wavelength, it is disclosed that a residual state of the liquid is determined by receiving the light of the second wavelength at the light receiving portion (refer to JP-A-2010-701).

However, since the liquid residual amount detection device according to JP-A-2010-701 optically detects a residual amount of the ink and only detects whether the amount of the ink in the ink cartridge is larger or smaller than a predetermined amount, there is a problem that it is impossible to accurately detect the residual amount of the ink in the ink cartridge.

SUMMARY

The invention can be realized in the following aspects or application examples.

Application Example 1

According to this application example, there is provided a liquid residual amount detection device that detects the amount of liquid in a container, the device including an irradiation unit that performs irradiation of a detection light, and a reaction detection unit that detects a reaction by the detection light irradiated by the irradiation unit, in which the amount of liquid is detected based on the amount of the detection light that reaches the reaction detection unit.

According to the application example, since a reaction such as refraction or reflection occurs depending on the position of the liquid level of the liquid in the container by the detection light irradiated by the irradiation unit, the amount of the detection light that reaches the reaction detection unit that detects the occurred reaction is measured. Therefore, the position of the liquid level of the liquid is detected from a correlation between the amount of the detection light that reaches the reaction detection unit and the residual amount of the liquid, and it is possible to detect the amount of the liquid in the container.

Application Example 2

It is preferable that the liquid residual amount detection device further include a relative position changing unit that relatively changes a position of the container and the irradiation unit, while the irradiation unit irradiates the container with the detection light, and a position detection unit that detects a relative position between the container and the irradiation unit, in which the amount of liquid be detected based on a detection position by the position detection unit when the reaction detection unit detects a change in reaction.

According to the application example, the position of the container and the irradiation unit are relatively changed while irradiating the detection light, and the relative position between the container and the irradiation unit is detected when it is detected that the detection light reaches the reaction detection unit. Therefore, the position of the liquid level of the liquid is detected from a correlation between the position of the irradiation unit when the detection light is detected by the reaction detection unit and the residual amount of the liquid and it is possible to detect the amount of the liquid in the container.

Application Example 3

It is preferable that the liquid residual amount detection device further include an optical member that is disposed on a side opposite to the irradiation unit with a mounted position of the container interposed therebetween, in which the reaction detection unit detect a reaction caused by the detection light which passes through the container and reaches the optical member.

According to the application example, after the detection light emitted from the irradiation unit passes through the container and reaches the optical member, a reaction such as refraction or reflection occurs depending on the position of the liquid level of the liquid in the container, and the reaction detection unit detects the reaction thereof. Therefore, it is possible to detect the amount of the liquid in the container from a correlation between the amount of the detection light that reaches the reaction detection unit and the residual amount of the liquid, or the correlation between the position of the irradiation unit when the detection light is detected by the reaction detection unit and the residual amount of the liquid.

Application Example 4

In the liquid residual amount detection device according to the application example, it is preferable that the container have the optical member in inside, and the reaction detection unit detect the reaction caused by the detection light that reaches the optical member.

According to the application example, since the liquid and the optical member in the container are included, depending on difference of the contact position between the liquid and the optical member, a reaction such as refraction or reflection caused by the detection light that reaches the optical member is detected by the reaction detection unit. Therefore, it is possible to detect the amount of the liquid in the container.

Application Example 5

In the liquid residual amount detection device according to the application example, it is preferable that the optical member include a prism, and is possible to change a traveling direction of the detection light.

According to the application example, the prism can change the traveling direction of the detection light according to the refractive index of the substance in contact. Accordingly, in the prism, the traveling direction of the detection light changes depending on the contact position with the liquid, and thus a change in the traveling direction of the irradiated detection light is detected. Therefore, it is possible to detect a change point between the position where the liquid and the prism come into contact with each other, and the position where the liquid and the prism do not come into contact with each other, and to detect the position of the liquid level of the liquid.

Application Example 6

In the liquid residual amount detection device according to the application example, it is preferable that the reaction detection unit be configured with an optical fiber, and receive the detection light at an end portion of the optical fiber.

According to the application example, by receiving the detection light at the end portion of the optical fiber, the other end portion of the optical fiber is connected to the reaction detection unit. Therefore, it is possible to reliably guide the detection light to the reaction detection unit to be detected. Therefore, it is possible to accurately detect the residual amount of the liquid in the container.

Application Example 7

According to this application example, there is provided a recording device including a recording unit that performs recording with ink supplied from an ink storage portion, a irradiation unit that performs irradiation of a detection light, and a reaction detection unit that detects a reaction by the detection light irradiated by the irradiation unit, in which the amount of ink stored in the ink storage portion is detected based on the amount of the detection light that reaches the reaction detection unit.

According to the application example, since the reaction such as refraction and reflection occurs depending on the position of the liquid level of the ink in the ink storage portion by the detection light irradiated by the irradiation unit, the amount of the detection light that reaches the reaction detection unit for detecting the occurred reaction is measured. Therefore, the position of the liquid level of the ink is detected from a correlation between the amount of the detection light that reaches the reaction detection unit and the residual amount of the ink, and it is possible to detect the amount of the ink in the ink storage portion.

Application Example 8

It is preferable that the liquid residual amount detection device further include a relative position changing unit which relatively changes a position of the ink storage portion and the irradiation unit, while the irradiation unit irradiates the ink storage portion with the detection light, and a position detection unit which detects a relative position between the ink storage portion and the irradiation unit, in which the amount of ink be detected based on a detection position by the position detection unit when the reaction detection unit detects a change in reaction.

According to the application example, the positions of the ink storage portion and the irradiation unit are relatively changed while irradiating the detection light to the ink storage portion, and the relative position between the ink storage portion and the irradiation unit is detected when it is detected that the detection light reaches the reaction detection unit. Therefore, the position of the liquid level of the ink is detected from the correlation between the position of the irradiation unit when the reaction detection unit detects the detection light and the residual amount of ink, and it is possible to detect the amount of the ink in the ink storage portion.

Application Example 9

According to this application example, there is provided a liquid residual amount detection method that detects the amount of liquid in a container, the method including performing irradiation of a detection light from a irradiation unit, and detecting a reaction by the detection light which is irradiated by the irradiation unit, in which the amount of liquid is detected based on the amount of the detection light in detecting the reaction.

According to the application example, since the reaction such as refraction and reflection occurs depending on the liquid level of the liquid in the container by the detection light irradiated by the irradiation unit, the amount of the detection light that reaches the reaction detection unit for detecting the occurred reaction is measured. Therefore, the position of the liquid level of the liquid is detected from the correlation between the amount of the detection light that reaches the reaction detection unit and the residual amount of the liquid, and it is possible to detect the amount of the liquid in the container.

Application Example 10

It is preferable that the liquid residual amount detection device further include changing relatively a position of the container and the irradiation unit while the irradiation unit irradiates the container with the detection light, and detecting a relative position between the container and the irradiation unit, in which the amount of liquid be detected based on a detection position obtained in the detecting of the relative position when a change in reaction is detected in the detecting of the reaction.

According to the application example, the positions of the container and the irradiation unit are relatively changed while irradiating the detection light, and the relative position between the container and the irradiation unit is detected when it is detected that the detection light reaches the reaction detection unit. Therefore, by a method of detecting the position of the liquid level of the liquid from the correlation between the position of the irradiation unit when the reaction detection unit detects the detection light and the residual amount of the liquid, it is possible to detect the amount of the liquid in the container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
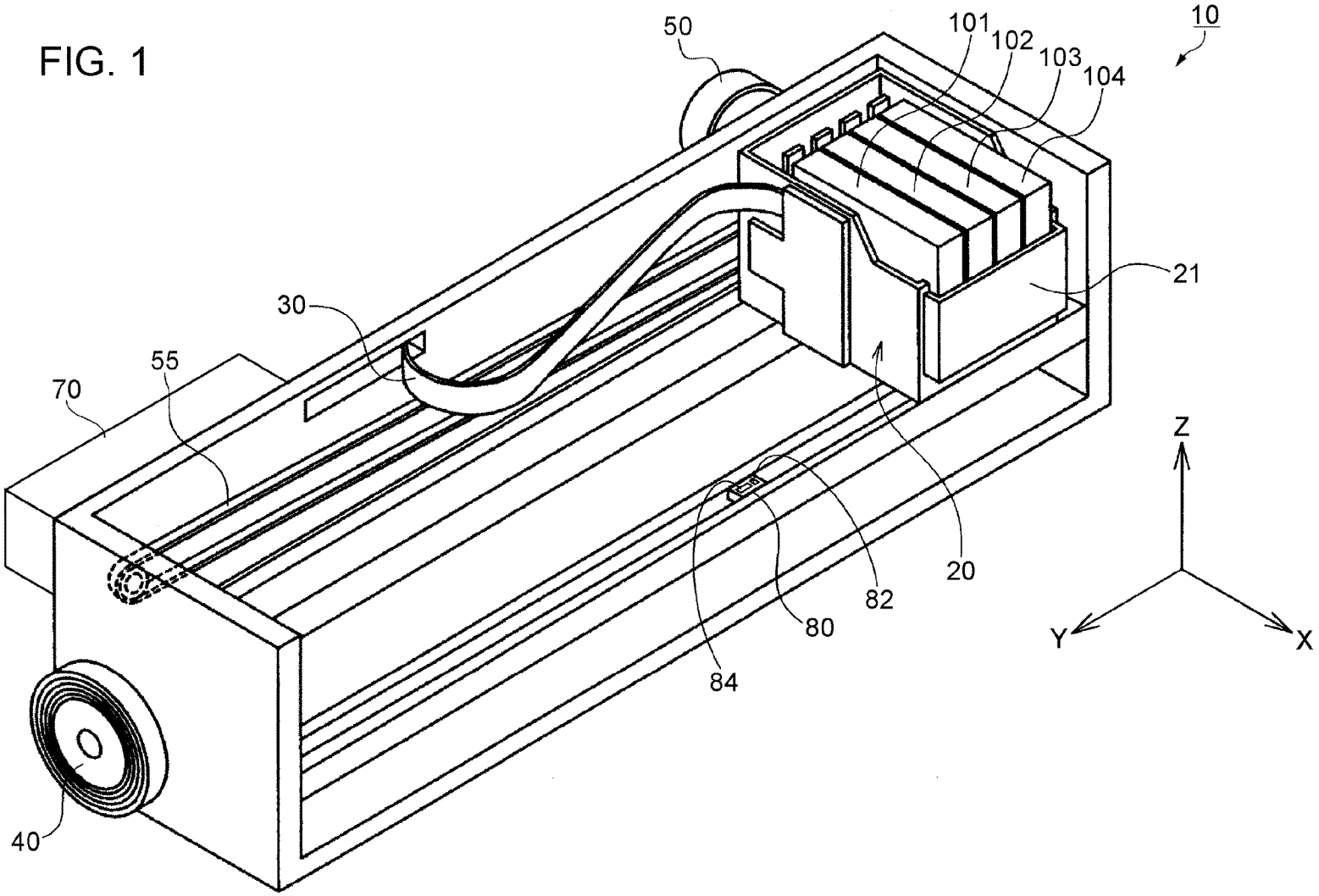
FIG. 1 is a perspective view illustrating a schematic configuration of a printing apparatus in the embodiment.

Hereinafter, an embodiment of the invention will be described in detail with reference to the drawings. In the following drawings, in order to make each configuration elements large enough to be recognized on the drawing, there are cases where dimensions or ratios of the configuration elements are described as being appropriately different from that of the actual configuration elements.

Printing Apparatus

First, a printing apparatus 10 is an example in a liquid residual amount detection device and a recording device according to the embodiment, and will be described with reference to FIG. 1.

Figure 2:
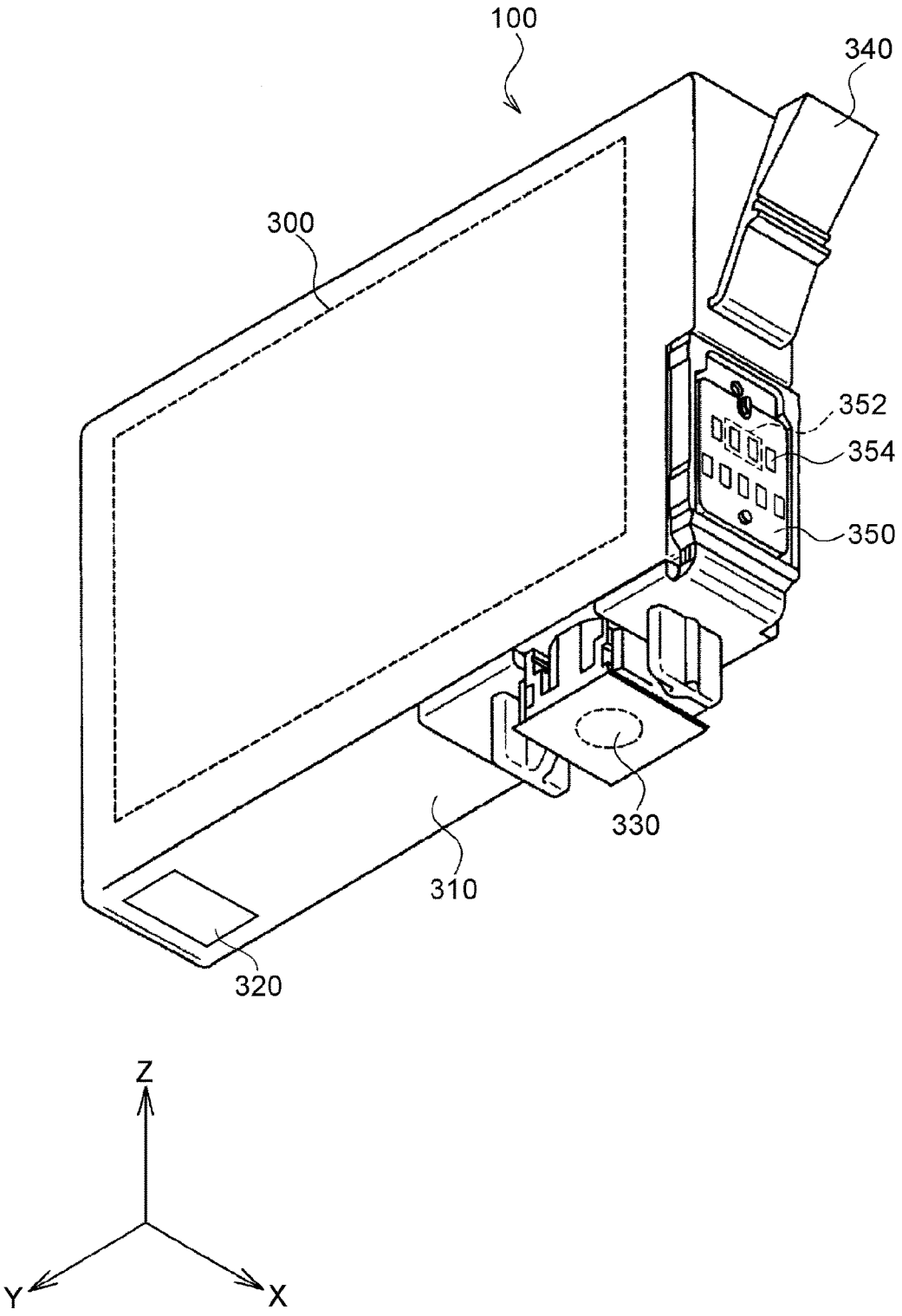
FIG. 2 is a perspective view illustrating a schematic configuration of an ink cartridge.

FIG. 1 is a perspective view illustrating a schematic configuration of a printing apparatus (example of the liquid residual amount detection device and the recording device) in the embodiment. An X direction, Y direction, and Z direction orthogonal to each other are illustrated in FIG. 1. In a normal use posture of the printing apparatus 10, a front direction of the printing apparatus 10 is defined as the X direction, and a vertical direction is defined as the Z direction. For example, taking the X direction as an example, the direction in which the arrow points is referred to as a +X direction (or simply the X direction), and the opposite direction thereof is referred to as a −X direction. The X direction, Y direction, and Z direction orthogonal to each other are illustrated in FIG. 2 and the following figures, similar to FIG. 1.

The printing apparatus 10 includes ink cartridges 101 to 104 (container) as an ink storage portion, a carriage 20 provided with a holder 21 for detachably accommodating the ink cartridges 101 to 104, a cable 30, a paper feed motor 40, a carriage motor 50, a carriage drive belt 55, a control unit 70, and a detection unit 80. A position on the carriage 20 becomes the mounted position of the ink cartridges 101 to 104. In addition, the holder 21 and the carriage 20 may be formed as an integral member. The holder 21 may be assembled to the carriage 20 being formed as separate members.

The ink cartridges 101 to 104 can independently store ink (liquid, and printing material) respectively having different colors and components. The ink cartridges 101 to 104 are detachably mounted on the holder 21. A head (not illustrated) serving as a recording unit is disposed on the surface in the −Z direction of the carriage 20. The ink supplied from the ink cartridges 101 to 104 is ejected from the head toward a recording medium (for example, printing paper). Hereinafter, a case where the recording medium is printing paper will be described as an example. The carriage 20 is connected to the control unit 70 by the cable 30, and an ejection control is performed by the control unit 70 via the cable 30. The paper feed motor 40 rotationally drives a paper feed roller (not illustrated) and feeds the printing paper in the X direction illustrated in FIG. 1. The carriage motor 50 drives the carriage drive belt 55 to move the carriage 20 in the ±Y direction. The control unit 70 controls the ejection, the paper feed, and the movement of the carriage 20, so that a printing operation is performed.

The detection unit 80 outputs a signal for detecting the ink residual state of the ink cartridges 101 to 104. Specifically, the detection unit 80 includes an irradiation unit 82 for irradiating detection light to the prism 200 (refer to FIG. 3) disposed in the ink cartridges 101 to 104, and a reaction detection unit 84 for detecting the detection light from the prism 200 and converting the detection light into an electric signal. For example, the irradiation unit 82 is configured with a light emitting panel, a light emission diode (LED) or the like, and the reaction detection unit 84 is configured with a phototransistor or the like.

Ink Cartridge

Next, the ink cartridge 100 (container) as the ink storage portion will be described with reference to FIG. 2.

FIG. 2 is a perspective view illustrating a schematic configuration of an ink cartridge.

The ink cartridge 100 illustrated in FIG. 2 corresponds to each ink cartridge of the ink cartridges 101 to 104 in FIG. 1.

As illustrated in FIG. 2, the ink cartridge 100 includes an ink containing portion 300 of a rectangular parallelepiped (including a substantially rectangular parallelepiped) storing the ink, a circuit substrate 350, a lever 340 for attaching and detaching the ink cartridge 100 to and from the holder 21, an ink supply port 330 for supplying the ink to a head, and an opening portion 320 disposed on a bottom surface 310 of the ink cartridge 100. A storage device 352 for storing information on the ink cartridge 100 is mounted on a back surface of the circuit substrate 350. A plurality of terminals 354 electrically connected to the storage device 352 are disposed on a front surface of the circuit substrate 350. When the ink cartridge 100 is mounted on the holder 21, the plurality of terminals 354 are electrically connected to the control unit 70 on the printing apparatus 10 side via a plurality of main body side terminals disposed in the holder 21. As the storage device 352, for example, a nonvolatile memory such as an EEPROM can be used.

The opening portion 320 is configured with a transparent member, transmits the detection light irradiated by the irradiation unit 82, and can allow the detection light to be incident on the inside of the ink containing portion 300.

First Embodiment

Next, the ink containing portion 300 which is an interior of the ink cartridge 100 according to the first embodiment of the invention will be described with reference FIGS. 3 and 4.

Figure 3:
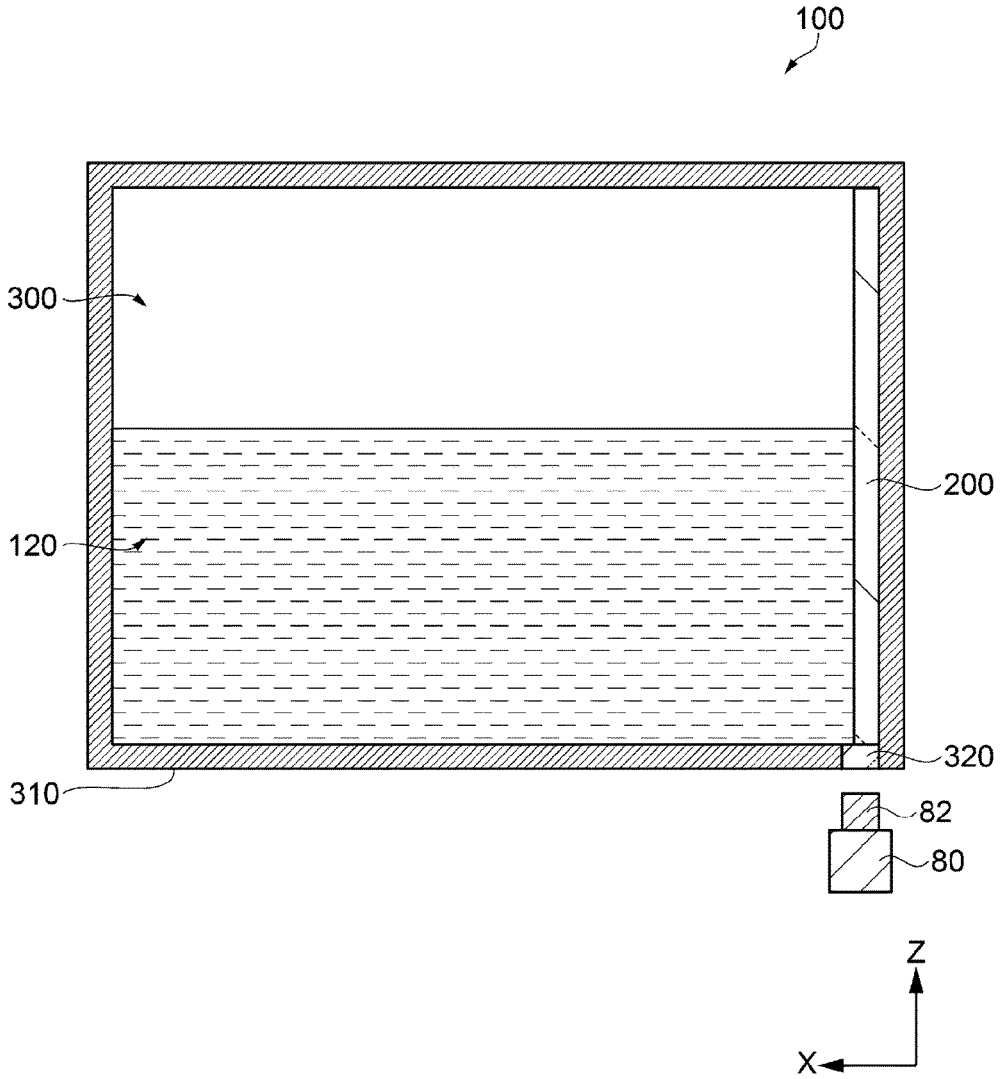
FIG. 3 is an XZ plane sectional view illustrating an internal structure of an ink cartridge according to a first embodiment.

FIG. 3 is an XZ plane sectional view illustrating an internal structure of an ink cartridge according to a first embodiment. FIG. 4 is a YZ plane sectional view illustrating the internal structure of the ink cartridge according to the first embodiment.

Figure 4:
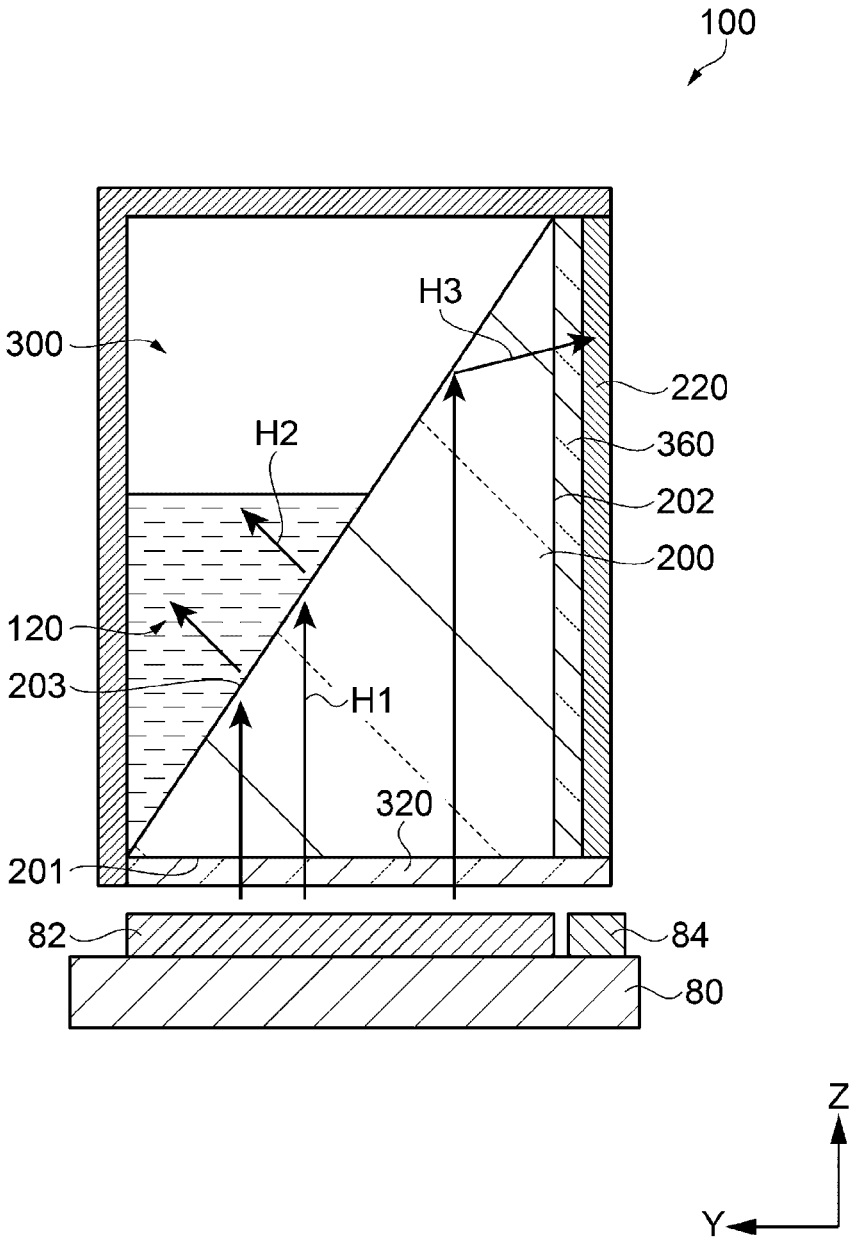
FIG. 4 is a YZ plane sectional view illustrating the internal structure of the ink cartridge according to the first embodiment.

As illustrated in FIGS. 3 and 4, a prism 200 as an optical member is disposed inside the ink containing portion 300, and a light scattering portion 220 is disposed along an inner wall portion 360 on the outer peripheral portion of the ink containing portion 300.

The prism 200 in the ink containing portion 300 is configured with a transparent member to the light from the irradiation unit 82, and is configured with, for example, polypropylene. In addition, the shape of the prism 200 is a flat plate having a thickness in the X direction and is a substantially right triangle.

In the prism 200, on the YZ plane in the −X direction configuring the ink containing portion 300, one side 201 constitutes a right angle is disposed along the opening portion 320 disposed on the bottom surface 310, and the other side 202 constitutes a right angle is disposed along the inner wall portion 360. An oblique side 203 of the prism 200 is disposed in contact with an end portion in the +Y direction of the opening portion 320 and an end portion in the +Z direction of the inner wall portion 360.

Next, a method for detecting the residual amount of the ink in the ink containing portion 300 will be described.

First, in FIG. 1, the carriage 20 on which the ink cartridges 101 to 104 are mounted is moved in the ±Y direction and one ink cartridge 100 among the ink cartridges 101 to 104 is disposed on the detection unit 80. Here, as illustrated in FIGS. 3 and 4, the irradiation unit 82 and the reaction detection unit 84 that configure the detection unit 80 are disposed at positions capable of facing the opening portion 320. The irradiation unit 82 is disposed at a position capable of facing the one side 201 of the prism 200, and the reaction detection unit 84 is disposed at a position capable of facing the light scattering portion 220.

Next, the detection light H1 is emitted (irradiation process) from the irradiation unit 82 such as a light emitting panel that emits parallel light to the entire prism 200. The emitted detection light H1 passes through the opening portion 320 and is incident on the prism 200 in the ink containing portion 300. When the detection light H1 passed through in the prism 200 reaches the oblique side 203, a traveling direction of the detection light H1 changes due to a difference in refractive index between the ink 120 and air. That is, the oblique side 203 of the prism 200 is refracted at a portion in contact with the ink 120, and becomes refracted light H2 to be radiated in the ink 120. However, in a portion where the oblique side 203 of the prism 200 is in contact with air, the detection light H1 is totally reflected, and a reflected light H3 passes through the inner wall portion 360 configured with a transparent material and reaches the light scattering portion 220.

Thereafter, since light scattering occurs in the light scattering portion 220 where the reflected light H3 is reached, in the reaction detection unit 84, a scattered light is detected (reaction detecting process), and the amount thereof is measured. Therefore, a position of a liquid level of the ink 120 is detected from a correlation between the amount of the scattered light detected by the reaction detection unit 84 and the residual amount of the ink 120 measured in advance, and it is possible to detect the amount of the ink 120 in the ink containing portion 300. It is possible to detect the amount of ink 120 in the ink containing portion 300 for the other ink cartridges 101 to 104 with the same method.

In a case where the amount of ink 120 in the ink containing portion 300 is large, since a portion the oblique side 203 of the prism 200 is in contact with air is small, the reflected light H3 reaching the light scattering portion 220 is small, and the amount of the scattered light in the light scattering portion 220 is small. Conversely, in a case where the amount of ink 120 in the ink containing portion 300 is decreased, since the portion the oblique side 203 of the prism 200 is in contact with air is large, and the reflected light H3 reaching the light scattering portion 220 is large, the amount of the scattered light in the light scattering portion 220 is increased. Accordingly, by measuring the amount of scattered light in the light scattering portion 220 in the reaction detection unit 84, the residual amount of the ink 120 in the ink containing portion 300 can be detected.

As described above, the printing apparatus 10 of the embodiment includes the irradiation unit 82 for irradiating the detection light H1, and the reaction detection unit 84 for detecting the reaction by the detection light H1 irradiated by the irradiation unit 82. Therefore, the irradiation unit 82 irradiates the prism 200 in the ink containing portion 300 with the detection light H1. Therefore, the reflected light H3 reflected by the portion of the prism 200 not in contact with the ink 120 reaches the light scattering portion 220. Thereafter, the scattered light generated in the light scattering portion 220 by the reached reflected light H3 is detected by the reaction detection unit 84 and the amount thereof is measured. Therefore, the position of a liquid level of the ink 120 is detected from a correlation between the amount of the scattered light (detection light H1) detected by the reaction detection unit 84 and the residual amount of the ink 120 measured in advance, and it is possible to detect the residual amount of the ink 120 in the ink containing portion 300.

In addition, when detecting the residual amount of the ink 120, the prism 200 is disposed at a position facing the irradiation unit 82 in a state of being held by the carriage 20, which is the mounted position of the ink cartridge 100. Therefore, the detection light H1 irradiated by the irradiation unit 82 passes through the opening portion 320 and reaches the prism 200. In the prism 200, the detection light H1 generates the reaction such as refraction and reflection depending on the liquid level of the ink 120 in the ink containing portion 300. Since the detection light H1 is reflected at the portion where the prism 200 is not in contact with the ink 120, the reaction detection unit 84 detects the reflected light H3 thereof, and measures the light amount. Therefore, it is possible to detect the residual amount of the ink 120 in the ink containing portion 300.

In addition, since the ink 120 and the prism 200 are provided inside the ink containing portion 300, the reaction such as the refraction and the reflection caused by the detection light H1 reaching the prism 200 is generated due to the difference in the contact position between the ink 120 and the prism 200, and the generated reaction is detected by the reaction detection unit 84. Therefore, it is possible to detect the amount of the ink 120 in the ink containing portion 300.

It is preferable that a liquid contacting surface of the prism 200 in contact with the ink 120 have a property of repelling a liquid (liquid repellency or water repellency) such as the ink 120. Even in a case where the ink 120 shakes inside the ink containing portion 300 and the ink 120 comes into contact with a wide range of the liquid contacting surface of the prism 200, since having this property makes it difficult to get wet, when the shaking of the liquid level settles down, the position of the liquid level can be likely to be immediately detected.

In addition, if the ink 120 has such a property that it is difficult for light to transmit, a configuration for irradiating the light and a configuration for detecting the light may be disposed at positions facing each other interposing the ink containing portion 300 with respect to a direction intersecting with the vertical direction. According to the configurations, at a location where the ink 120 in the ink containing portion 300 is present, the light irradiated by the configuration that irradiates the light is difficult to reach the configuration that detects the light, and the location where the light is likely to transmit is detected. Therefore, it is possible to detect the position of the liquid level of the ink 120, and to detect the residual amount of the ink 120 with a relatively simple configuration.

Second Embodiment

Next, an ink cartridge 100*a* according to the second embodiment of the invention will be described with reference FIG. 5.

Figure 5:
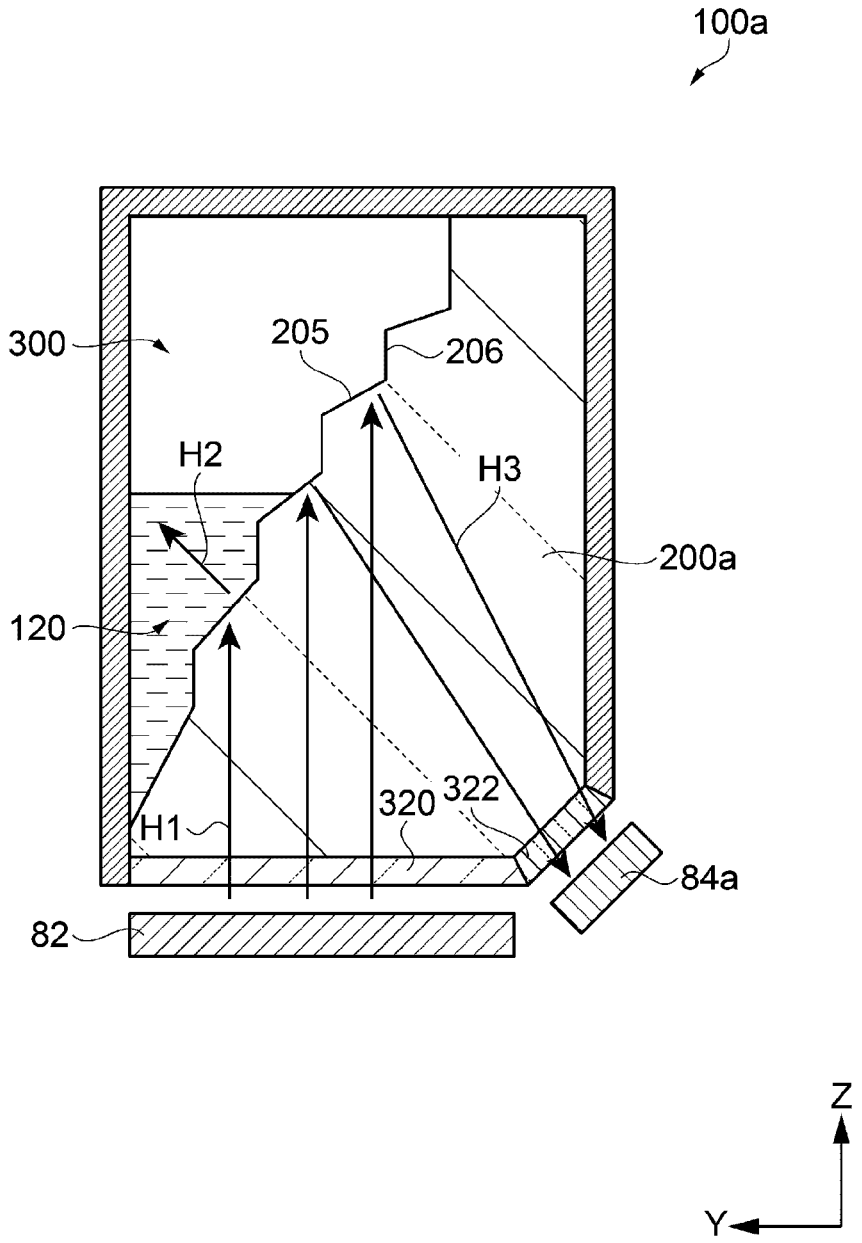
FIG. 5 is a YZ plane sectional view illustrating an internal structure of an ink cartridge according to a second embodiment.

FIG. 5 is a YZ plane sectional view illustrating an internal structure of an ink cartridge according to a second embodiment.

The ink cartridge 100*a* of the embodiment is the same as the first embodiment described above, except that an outer shape of the ink cartridge 100*a*, a shape of a prism 200*a*, and an arrangement position of the reaction detection unit 84*a* are different.

In the following description, with respect to the second embodiment, differences from the embodiment described above will be mainly described, and description of similar matters will be omitted. In addition, in FIG. 5, the same reference numerals are given to the same configurations as the embodiment described above.

As illustrated in FIG. 5, in the ink cartridge 100*a* of the embodiment, an outer shape of the YZ plane is a rectangular shape, a corner of four corners has a chamfered structure, and a detection opening portion 322 configured with the transparent member is disposed. In addition, in the shape of the prism 200*a* disposed in the ink containing portion 300, the surface where the detection light H1 which has been emitted from the irradiation unit 82 and passes through the inside of the prism 200*a* reaches is configured by a plurality of inclined portions 205 and a plurality of vertical portions 206. In the plurality of inclined portions 205 of the prism 200*a*, an inclination angle is designed such that when the detection light H1 is totally reflected by each of the inclined portions 205, the reflected light H3 passes through the detection opening portion 322 and reaches the reaction detection unit 84*a*.

Therefore, the detection light H1 emitted from the irradiation unit 82 becomes the refracted light H2 in the inclined portion 205 which is in contact with the ink 120 and is radiated into the ink 120, and is totally reflected in the inclined portion 205 which is in contact with the air, and is a region where the ink 120 is absent. The reflected light H3 passes through the detection opening portion 322 and is irradiated to the reaction detection unit 84*a*. Accordingly, since the amount of reflected light H3 varies in accordance with the amount of ink 120 in the ink containing portion 300, the amount of the reflected light H3 is measured by the reaction detection unit 84*a*. Therefore, it is possible to detect the amount of ink 120 in the ink containing portion 300.

Third Embodiment

Next, an ink cartridge 100*b* according to the third embodiment of the invention will be described with reference FIG. 6.

Figure 6:
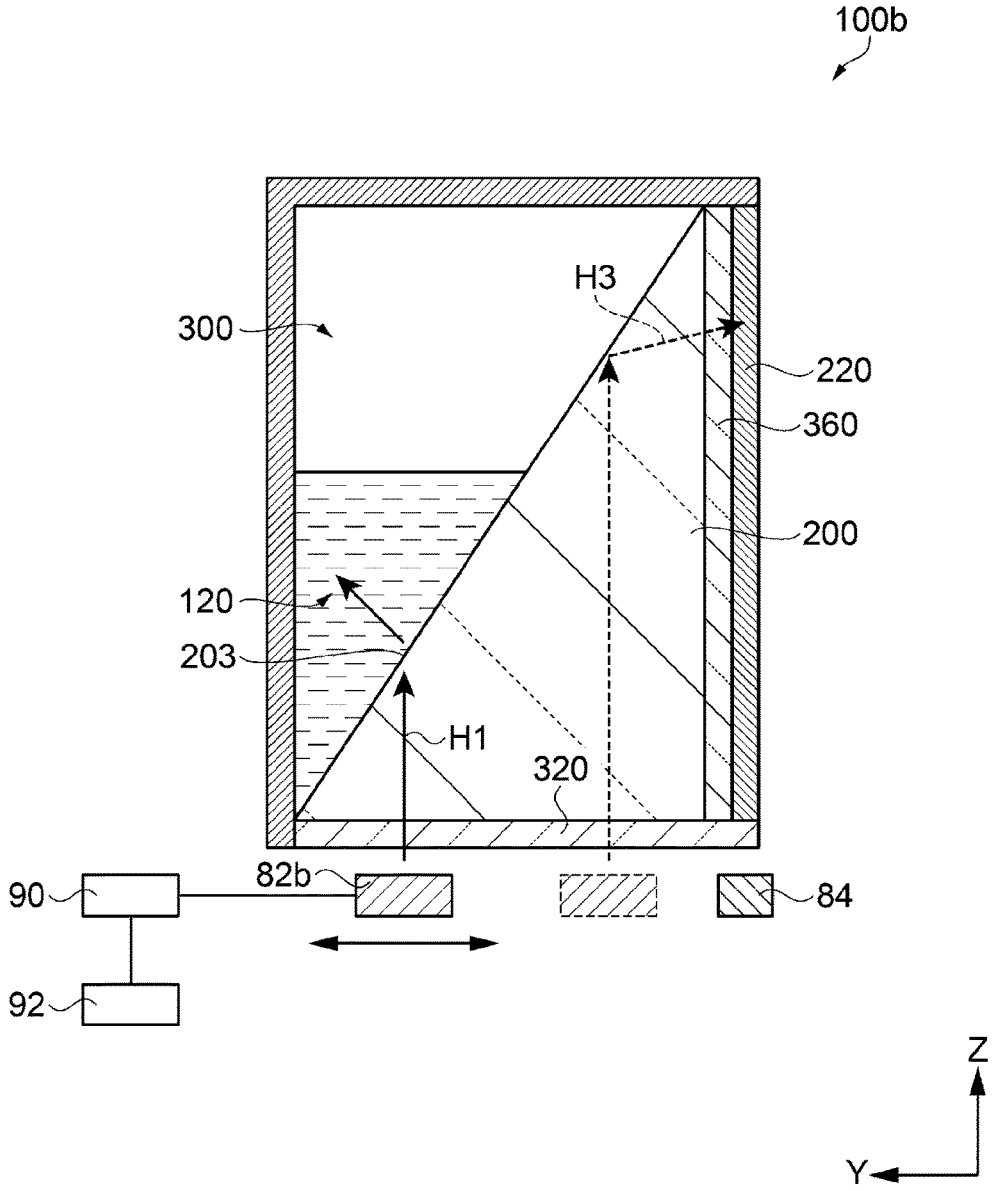
FIG. 6 is a YZ plane sectional view illustrating an internal structure of an ink cartridge according to a third embodiment.

FIG. 6 is a YZ plane sectional view illustrating an internal structure of an ink cartridge according to a third embodiment.

The ink cartridge 100*b* of the embodiment is the same as the first embodiment described above, except that a configuration of a irradiation unit 82*b* is different.

In the following description, with respect to the third embodiment, differences from the embodiment described above will be mainly described, and description of similar matters will be omitted. In addition, in FIG. 6, the same reference numerals are given to the same configurations as the embodiment described above.

As illustrated in FIG. 6, the ink cartridge 100*b* of the embodiment is configured so that the irradiation unit 82*b* can move in the ±Y direction. The irradiation unit 82*b* moves in the ±Y direction by a relative position changing unit 90 that relatively changes the positions of the ink cartridge 100*b* and the irradiation unit 82*b*, and the position in the ±Y direction is detected by a position detection unit 92 that detects the relative position between the ink cartridge 100*b* and the irradiation unit 82*b*.

The relative position changing unit 90 moves (relative position changing process) from the +Y direction to the −Y direction while the irradiation unit 82*b* such as LED that emits single light emits the detection light H1 (irradiation process). Therefore, the detection light H1 is refracted at a portion where the oblique side 203 of the prism 200 is in contact with the ink 120 and becomes the refracted light H2 and is radiated into the ink 120. Thereafter, when the oblique side 203 of the prism 200 becomes the portion where is in contact with the air, the detection light H1 is totally reflected. The reflected light H3 passes through the inner wall portion 360 configured with the transparent material and is irradiated to the light scattering portion 220. Therefore, in the light scattering portion 220 irradiated with the reflected light H3, an occurrence of the light scattering is detected by the reaction detection unit 84 (reaction detection process). Therefore, the position detection unit 92 detects the position of the irradiation unit 82*b* (position detection process), a position of the liquid level of the ink 120 is detected from the correlation between the position of the irradiation unit 82*b* detected by the reaction detection unit 84 and the residual amount of the ink 120 measured in advance, and it is possible to detect the amount of the ink 120 in the ink containing portion 300. In the embodiment, although the irradiation unit 82*b* is moved from the +Y direction to the −Y direction and the amount of the ink 120 is detected, without being limited thereto, and the irradiation unit 82*b* may be moved from the −Y direction to the +Y direction and the amount of ink 120 may be detected.

In addition, by moving the carriage 20, it is also possible to change the relative position between the ink cartridge 100*b* and the irradiation unit 82*b*, and by detecting the position of the carriage 20, it is possible to confirm the relative position between the ink cartridge 100*b* and the irradiation unit 82*b*. The relative position changing unit 90 in this case is the carriage motor 50 or the carriage drive belt 55, and since there is not required to dispose a dedicated mechanism, the configuration of the apparatus can be simplified.

As described above, the printing apparatus 10 of the embodiment is provided with the relative position changing unit 90 that relatively changes the position of the ink cartridge 100*b* and the irradiation unit 82*b*, and the position detection unit 92 that detects the relative position between the ink cartridge 100*b* and the irradiation unit 82*b*, while the irradiation unit 82*b* irradiates the ink cartridge 100*b* with the detection light H1. Therefore, it is possible to relatively changes the positions of the ink cartridge 100*b* and the irradiation unit 82*b* while irradiating the detection light H1, and to detect the relative position between the ink cartridge 100*b* and the irradiation unit 82*b*, when it is detected that the detection light H1 reaches the reaction detection unit 84. Accordingly, it is possible to detect the position of the liquid level of the ink 120 from the correlation between the position of the irradiation unit 82*b* and the residual amount of the ink 120 when the reaction detection unit 84 detects the detection light H1, and to detect the residual amount of the ink 120 in the ink containing portion 300.

Fourth Embodiment

Next, an ink cartridge 100*c* according to the fourth embodiment of the invention will be described with reference FIG. 7.

Figure 7:
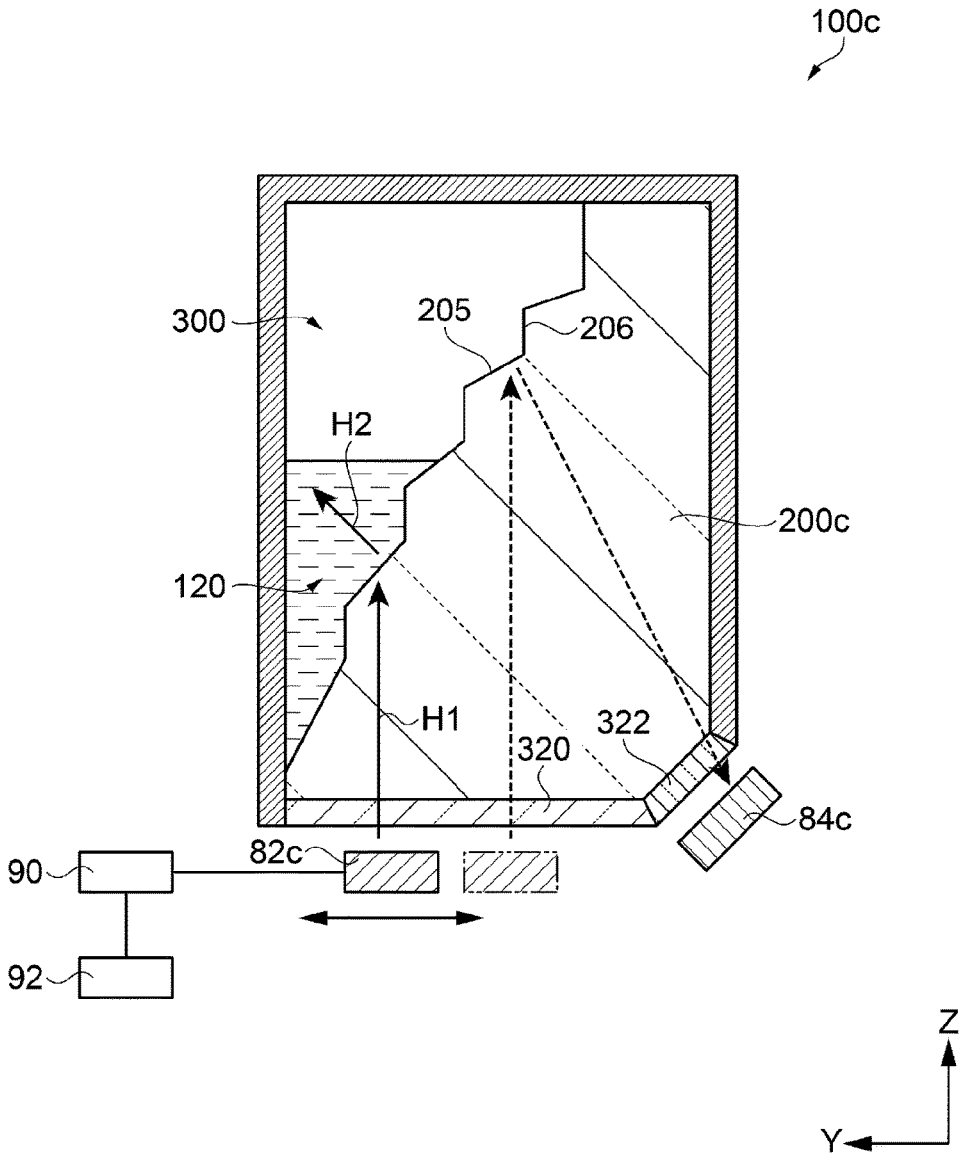
FIG. 7 is a YZ plane sectional view illustrating an internal structure of an ink cartridge according to a fourth embodiment.

FIG. 7 is a YZ plane sectional view illustrating an internal structure of an ink cartridge according to a fourth embodiment.

The ink cartridge 100*c* of the embodiment has a combined configuration of the configuration of the second embodiment and the configuration of the third embodiment.

In the following description, with respect to the fourth embodiment, differences from the embodiment described above will be mainly described, and description of similar matters will be omitted. In addition, in FIG. 7, the same reference numerals are given to the same configurations as the embodiment described above.

As illustrated in FIG. 7, in the ink cartridge 100*c* of the embodiment, a corner of four corners has a chamfered structure, and the detection opening portion 322 configured with the transparent member is disposed. In addition, in the shape of the prism 200*c* disposed in the ink containing portion 300, the surface where the detection light H1 which has been emitted from the irradiation unit 82*c* and passes through the inside of the prism 200*c* reaches is configured by the plurality of inclined portions 205 and the plurality of vertical portions 206. In the plurality of inclined portions 205 of the prism 200*c*, an inclination angle is designed such that when the detection light H1 is totally reflected by each of the inclined portions 205, the reflected light H3 passes through the detection opening portion 322 and reaches the reaction detection unit 84*c*.

The irradiation unit 82*c* is configured to be movable in the ±Y direction. The irradiation unit 82*c* moves in the ±Y direction by the relative position changing unit 90 that relatively changes the positions of the ink cartridge 100*c* and the irradiation unit 82*c*, and the position in the ±Y direction is detected by the position detection unit 92 that detects the relative position between the ink cartridge 100*c* and the irradiation unit 82*c*.

The relative position changing unit 90 moves from the +Y direction to the −Y direction while the irradiation unit 82*c* such as LED that emits single light emits the detection light H1. Therefore, the detection light H1 is refracted at a portion where the inclined portion 205 of the prism 200*c* is in contact with the ink 120 and becomes the refracted light H2 and is radiated into the ink 120. Thereafter, when the inclined portion 205 of the prism 200*c* becomes the portion where is in contact with the air, the detection light H1 is totally reflected. The reflected light H3 passes through the detection opening portion 322 and is irradiated to the reaction detection unit 84*c*. Therefore, since the detection position of the irradiation unit 82*c* when the reflected light H3 is detected by the reaction detection unit 84*c* is known, the position of the liquid level of the ink 120 is detected from the correlation between the position of the irradiation unit 82*c* detected by the reaction detection unit 84*c* and the residual amount of the ink 120 measured in advance, and it is possible to detect the amount of the ink 120 in the ink containing portion 300.

Fifth Embodiment

Next, an ink cartridge 100*d* according to the fifth embodiment of the invention will be described with reference FIG. 8.

Figure 8:
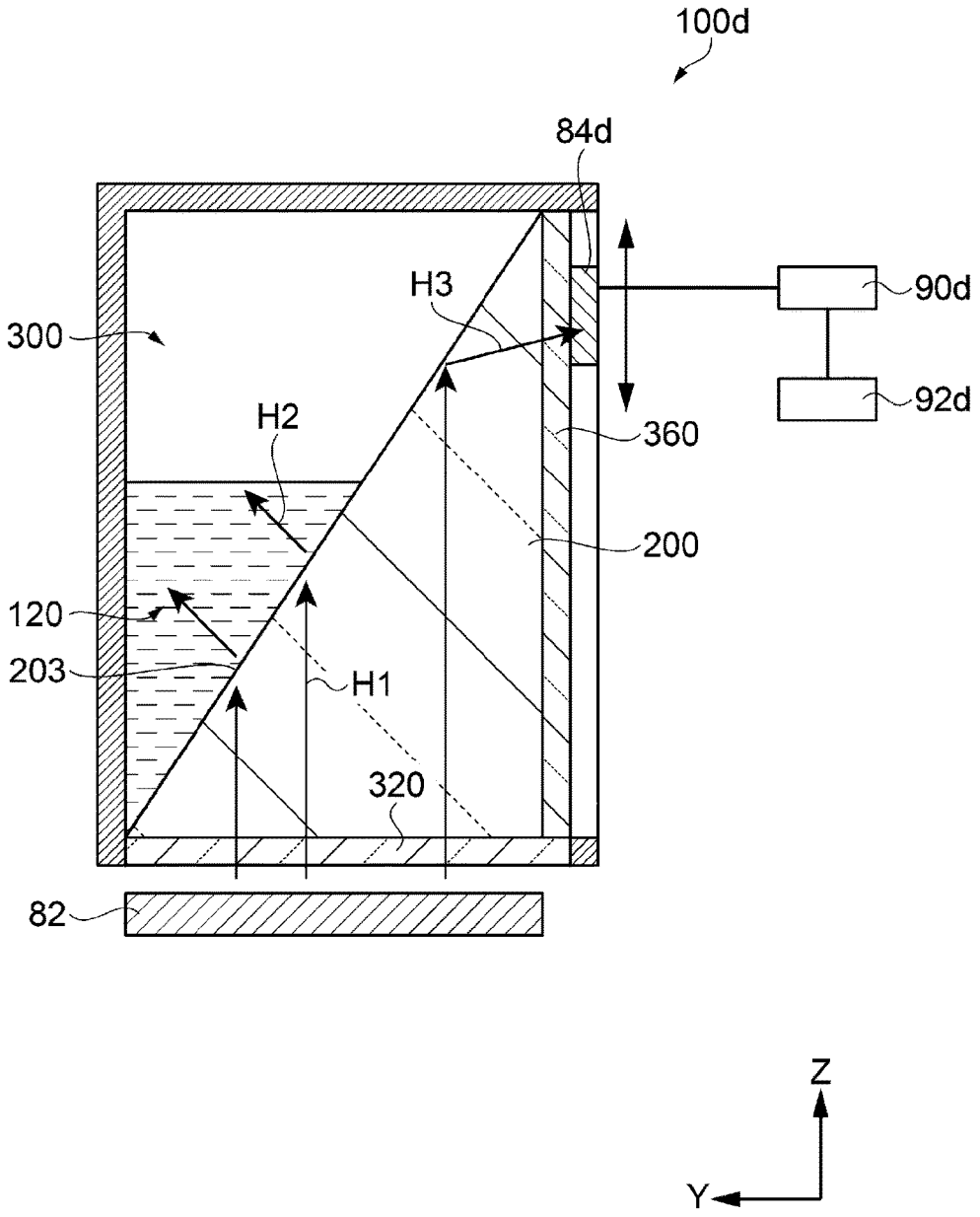
FIG. 8 is a YZ plane sectional view illustrating an internal structure of an ink cartridge according to a fifth embodiment.

FIG. 8 is a YZ plane sectional view illustrating an internal structure of an ink cartridge according to a fifth embodiment.

The ink cartridge 100*d* of the embodiment is the same as the first embodiment described above, except that a configuration of a reaction detection unit 84*d* are different.

In the following description, with respect to the fifth embodiment, differences from the embodiment described above will be mainly described, and description of similar matters will be omitted. In addition, in FIG. 8, the same reference numerals are given to the same configurations as the embodiment described above.

As illustrated in FIG. 8, the reaction detection unit 84*d* is disposed along the inner wall portion 360 and the ink cartridge 100*d* of the embodiment is configured to be movable in the ±Z direction by the relative position changing unit 90*d*. In addition, the position in the ±Z direction is detected by a position detection unit 92*d* that detects the relative position between the ink cartridge 100*d* and the reaction detection unit 84*d*.

The detection light H1 emitted from the irradiation unit 82 that emits parallel light to the entire prism 200 passes through the opening portion 320, is incident on the prism 200 in the ink containing portion 300, and reaches the oblique side 203 of the prism 200. Thereafter, the detection light H1 is refracted at a portion where the ink 120 and the prism 200 are in contact with each other, becomes the refracted light H2 to be radiated into the ink 120, is totally reflected at the portion where the air and the prism 200 are in contact with each other, and becomes the reflected light H3 to be irradiated to the reaction detection unit 84*d* side. Here, when the reaction detection unit 84*d* is moved in the −Z direction from the +Z direction by the relative position changing unit 90*d*, the reaction detection unit 84*d* which has received the reflected light H3 does not receive the reflected light H3 when the reaction detection unit 84*d* reaches the portion where the oblique side 203 of the prism 200 comes into contact with the ink 120. Therefore, the position detection unit 92*d* detects the position where the reaction detection unit 84*d* does not receive the reflected light H3. Therefore, the position of the liquid level of the ink 120 is detected from the correlation between the position of the reaction detection unit 84*d* detected and the residual amount of the ink 120 measured in advance, and it is possible to detect the amount of the ink 120 in the ink containing portion 300. In the embodiment, although the reaction detection unit 84*d* is moved from the +Z direction to the −Z direction and the amount of the ink 120 is detected, without being limited thereto, and the reaction detection unit 84*d* may be moved from the −Z direction to the +Z direction and the amount of ink 120 may be detected.

Sixth Embodiment

Next, an ink cartridge 100*e* according to the sixth embodiment of the invention will be described with reference FIG. 9.

Figure 9:
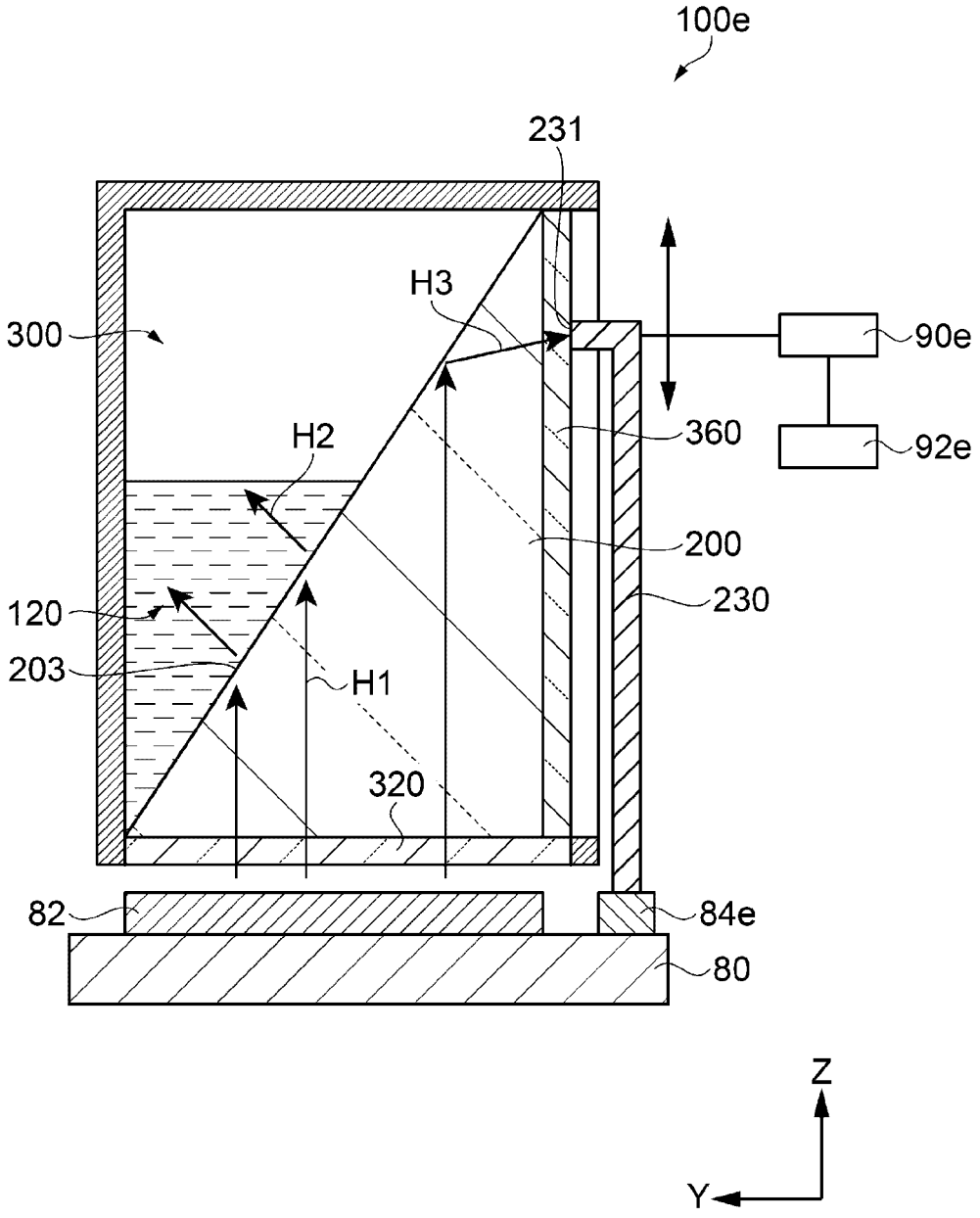
FIG. 9 is a YZ plane sectional view illustrating an internal structure of an ink cartridge according to a sixth embodiment.

FIG. 9 is a YZ plane sectional view illustrating an internal structure of an ink cartridge according to a sixth embodiment.

The ink cartridge 100*e* of the embodiment is the same as the first embodiment described above, except that a configuration of a reaction detection unit 84*e* is different.

In the following description, with respect to the sixth embodiment, differences from the embodiment described above will be mainly described, and description of similar matters will be omitted. In addition, in FIG. 9, the same reference numerals are given to the same configurations as the embodiment described above.

As illustrated in FIG. 9, in the ink cartridge 100*e* of the embodiment, the reaction detection unit 84*e* is connected to an optical fiber 230. The end portion 231 of the optical fiber 230 is configured to be movable in the ±Z direction by the relative position changing unit 90*e*. In addition, the position in the ±Z direction is detected by the position detection unit 92*d* that detects the relative position between the ink cartridge 100*e* and the reaction detection unit 84*e*.

The detection light H1 emitted from the irradiation unit 82 is the refracted light H2 or the reflected light H3 depending on whether or not the oblique side 203 of the prism 200 is in contact with the ink 120. Therefore, the reflected light H3 generated when not in contact with the ink 120 is received at the end portion 231 of the optical fiber 230 and guided to the reaction detection unit 84*e* connected to the other end portion of the optical fiber 230 to be detected. At that time, the position detection unit 92*d* detects whether the position where the reflected light H3 starts to be received or the position where the reflected light H3 is not received. Therefore, the position of the liquid level of the ink 120 is detected from the correlation between the position of the reaction detection unit 84*e* detected and the residual amount of the ink 120 measured in advance, and it is possible to detect the amount of the ink 120 in the ink containing portion 300.

Hereinbefore, the configuration of each unit of the invention can be replaced by an arbitrary configuration which exhibits the same function of the embodiment described above, and an arbitrary configuration can be added. In addition, in the invention, arbitrary configurations of each embodiment described above may be combined with each other.

This application claims priority under 35 U.S.C. § 119 to Japanese Patent Application No. 2016-061374, filed Mar. 25, 2016. The entire disclosure of Japanese Patent Application No. 2016-061374 is hereby incorporated herein by reference.

What is claimed is:

1. A liquid residual amount detection device that detects an amount of liquid in a container, the device comprising:

an irradiation unit that performs irradiation of a detection light into the container, an optical member having a diagonal side extending from top to bottom of the container; and a reaction detection unit that detects a reaction of the detection light irradiated by the irradiation unit and that reaches the diagonal side of the optical member, wherein:

the detection light not in contact with the liquid is reflected by the optical member to the reaction detection unit, the detection light in contact with the liquid is refracted into the liquid, and a continuous amount of liquid is detected based on an amount of the detection light that reaches the reaction detection unit.

2. The liquid residual amount detection device according to claim 1, further comprising:

a relative position changing unit that relatively changes a position of the container and the irradiation unit, while the irradiation unit irradiates the container with the detection light; and a position detection unit that detects a relative position between the container and the irradiation unit, wherein the amount of liquid is detected based on a detection position by the position detection unit when the reaction detection unit detects a change in reaction.

3. The liquid residual amount detection device according to claim 1, the optical member being disposed on a side opposite to the irradiation unit with a mounted position of the container interposed therebetween, wherein the reaction detection unit detects a reaction caused by the detection light that passes through the container and reaches the optical member.

4. The liquid residual amount detection device according to claim 1, the reaction detection unit detecting the reaction caused by the detection light that reaches the optical member.

5. The liquid residual amount detection device according to claim 3, wherein the optical member includes a prism that makes it possible to change a traveling direction of the detection light.

6. The liquid residual amount detection device according to claim 1, wherein the reaction detection unit is configured with an optical fiber, and receives the detection light at an end portion of the optical fiber.

7. A recording device comprising:

a recording unit that performs recording with ink supplied from an ink storage portion;

an irradiation unit that performs irradiation of a detection light into the container, wherein the container has an optical member that has a diagonal side extending from top to bottom of the container; and a reaction detection unit that detects a reaction of the detection light irradiated by the irradiation unit that reaches the diagonal side of the optical member, wherein:

the detection light not in contact with the liquid is reflected by the optical member to the reaction detection unit, the detection light in contact with the liquid is refracted into the liquid, and a continuous amount of ink stored in the ink storage portion is detected based on an amount of the detection light that reaches the reaction detection unit.

8. The recording device according to claim 7, further comprising:

a relative position changing unit that relatively changes a position of the ink storage portion and the irradiation unit, while the irradiation unit irradiates the ink storage portion with the detection light; and a position detection unit that detects a relative position between the ink storage portion and the irradiation unit, wherein the amount of ink is detected based on a detection position by the position detection unit when the reaction detection unit detects a change in reaction.

9. A liquid residual amount detection method that detects an amount of liquid in a container, the method comprising:

performing irradiation of detection light from a irradiation unit into the container, wherein the container has an optical member that has a diagonal side from top to bottom of the container; and detecting a reaction by the detection light that is irradiated of the irradiation unit that reaches the diagonal side of the optical member, wherein:

the detection light not in contact with the liquid is reflected by the optical member to the reaction detection unit, the detection light in contact with the liquid is refracted into the liquid, and a continuous amount of liquid is detected based on an amount of the detection light in detecting the reaction.

10. The liquid residual amount detection method according to claim 9, further comprising:

changing relatively a position of the container and the irradiation unit, while the irradiation unit irradiates the container with the detection light; and detecting a relative position between the container and the irradiation unit, wherein the amount of liquid is detected based on a detection position obtained in the detecting of the relative position when a change in reaction is detected in the detecting of the reaction.

11. The liquid residual amount detection device according to claim 1, the diagonal side of the optical member extending from top to bottom of the container in a straight line.

12. The liquid residual amount detection device according to claim 1, the diagonal side of the optical member extending from top to bottom of the container in a jagged line.

13. The liquid residual amount detection method according to claim 9, the diagonal side of the optical member extending from top to bottom of the container in a straight line.

14. The liquid residual amount detection method according to claim 9, the diagonal side of the optical member extending from top to bottom of the container in a jagged line.

* * * * *